US005720596A

United States Patent [19]

Pepperman

[11] Patent Number: 5,720,596

[45] Date of Patent: Feb. 24, 1998

[54] APPARATUS AND METHOD FOR LOCKING BLADES INTO A ROTOR

[75] Inventor: Michael Barton Pepperman, Winter Springs, Fla.

[73] Assignee: Westinghouse Electric Corporation, Pittsburgh, Pa.

[21] Appl. No.: 778,923

[22] Filed: Jan. 3, 1997

[51] Int. Cl.[6] ..... B63H 1/20

[52] U.S. Cl. ..... 416/220 R; 416/248

[58] Field of Search ..... 416/220 R, 220 A, 416/219 R, 248

[56] References Cited

U.S. PATENT DOCUMENTS

| | | | |
|---|---|---|---|
| 1,890,581 | 12/1932 | Kohler et al. . | |
| 2,751,189 | 6/1956 | Ledwith et al. . | |
| 2,753,149 | 7/1956 | Kurti et al. . | |
| 2,843,356 | 7/1958 | Hull et al. . | |
| 2,867,408 | 1/1959 | Kolb et al. . | |
| 2,942,842 | 6/1960 | Hayes et al. . | |
| 2,949,278 | 7/1960 | McCormick et al. . | |
| 2,994,507 | 8/1961 | Keller et al. . | |
| 3,001,760 | 9/1961 | Guernsey et al. . | |
| 3,202,398 | 8/1965 | Webb et al. . | |
| 3,309,058 | 3/1967 | Vaughan et al. . | |
| 3,393,862 | 7/1968 | Harrison et al. . | |
| 3,759,633 | 9/1973 | Tournere et al. . | |
| 3,904,317 | 9/1975 | Cardin et al. | 416/220 R |
| 4,050,850 | 9/1977 | Beckershoff et al. . | |
| 4,265,595 | 5/1981 | Buoy, Jr. et al. | 416/220 R |
| 4,466,776 | 8/1984 | Camboultives . | |
| 4,474,535 | 10/1984 | Dhuic | 446/220 R |
| 4,676,723 | 6/1987 | Kiger et al. . | |
| 4,915,587 | 4/1990 | Pisz et al. . | |
| 5,425,621 | 6/1995 | Maar | 416/220 R |
| 5,443,366 | 8/1995 | Knott et al. | 416/220 R |

FOREIGN PATENT DOCUMENTS

| | | | |
|---|---|---|---|
| 500250 | 1/1951 | Belgium | 416/219 R |
| 620225 | 5/1961 | Canada | 416/220 R |
| 2292856 | 6/1976 | France | 416/220 R |
| 54-130710 | 3/1978 | Japan . | |
| 0130710 | 10/1979 | Japan | 416/220 R |
| 0139904 | 6/1987 | Japan | 416/220 R |
| 313027 | 4/1956 | Switzerland . | |

*Primary Examiner*—Thomas E. Denion

[57] ABSTRACT

A blade is locked into groove in the periphery of a turbomachine rotor by forming mating notches in opposing faces of the blade root and groove so as to form a blind hole. At assembly, a slotted radial pin is installed into the blind hole so as to prevent axial motion of the blade root. The pin is rotated so as to align its slot with a slot formed along the length of the rotor groove. A retaining strip is slid into the rotor groove slot so that it extends through the slot in the radial pin, with a pre-bent end of the strip resting against one face of the rotor. A tab formed on the other end of the strip is bent against another face of the rotor so as to lock the retaining strip in place. At dis-assembly, one of the retaining strip tabs is unbent and the retaining strip slid out. The pin is then extracted, thereby allowing the blade to be removed.

15 Claims, 3 Drawing Sheets

APPARATUS AND METHOD FOR LOCKING BLADES INTO A ROTOR

BACKGROUND OF THE INVENTION

The present invention relates to rotors, such as those used in compressors, fans and turbines.

Compressors, fans, turbines and like machinery employ rotors to which a plurality of blades are affixed. Such blades are arranged into one or more rows spaced axially along the rotor, the blades in each row being circumferentially arrayed around the periphery of the rotor.

As a result of the high steady and vibratory forces imposed on the blades during operation, the method of attaching the blades to the rotor shaft requires careful design. One method of attachment employs approximately axially extending grooves formed in the periphery of the rotor shaft. The shape of the grooves may be that of a fir-tree, semi-circle, inverted T, or some variation thereof. Each blade has a corresponding root portion at its base which is closely profiled to match the shape of the rotor grooves. Each blade is retained in the rotor by sliding the root of the blade into a rotor groove. Blades affixed to the rotor in this manner are referred to as side entry blades. As a result of the close match in the size and shape of the blade root and the rotor groove, motion of the blade in the tangential and radial directions is closely restrained.

During full speed operation the blades are urged axially forward by the pressure rise across the row of blades. The centrifugal force on the blades is very high however. Hence there is more than adequate frictional resistance in the blade roots to prevent them from sliding forward. However, when a gas turbine is shut down, its rotor is not allowed to come to rest immediately. Instead the rotor is usually rotated at low speed until it cools sufficiently to prevent gravity from forming a bow in the hot rotor since such a bow would result in high vibration during the next start up. This low speed cooling operation may continue for several days, during which time the compressor blade can migrate out of its groove. Consequently, it is necessary to restrain the motion of the compressor blades in the axial direction, a process referred to as "locking."

In the past, locking has been accomplished by a spring loaded radial pin. In this approach each blade is installed by first disposing a spring in a hole in the bottom of the rotor groove and compressing the spring by forcing a pin into the hole on top of the spring. The blade root is slid into the groove and is locked when a slot, machined in the bottom of the root, passes over the pin, allowing the spring force to drive the pin partially out of the hole and into the slot. Blades are removed by applying an axial force to the blade root sufficient to shear the pin in half, allowing the blade to be withdrawn.

Unfortunately, this approach suffers from several disadvantages. First, the locking device is hidden from view and its correct installation cannot be ascertained visually once the blade is inserted into the groove. Since there may be well over 1,000 blades in each rotor, this disadvantage makes inspection of the rotor for proper locking difficult and time-consuming. However, a single unlocked compressor blade can result in substantial damage to the rotating blades and stationary vanes of the compressor and render the gas turbine unavailable for use until repaired. It should be noted that many of the locking devices utilized in the prior art suffer from a similar disadvantage.

Second, the locking pin is subject, or rare occasions, to being disengaged, thereby allowing the compressors blades to "walk" forward during the low speed cooling rotation so as to contact an adjacent row of stationary vanes.

More recently, blades have been locked using circumferential locking mechanisms. Such as approach is disclosed in U.S. Pat. No. 4,915,587 (Pisz et al). However, this approach requires expensive machined locking keys and complex machining of the rotor.

It is therefore desirable to provide a an apparatus and method for locking blades in a rotor that is cost effective and that will allow inspection of the locking device.

SUMMARY OF THE INVENTION

Accordingly, it is the general object of the current invention to provide an apparatus and method for locking blades in a rotor.

Briefly, this object, as well as other objects of the current invention, is accomplished in a turbo-machine rotor assembly, comprising (i) a blade having a root portion, a first notch formed in the root, the first notch forming a portion of the periphery of a hole (ii) a groove for retaining the blade root, a second notch formed in the rotor groove, the second notch disposed opposite the first notch and forming the remaining portion of the periphery of the hole, (iii) a pin disposed in the hole formed by the first and second notches, and (iv) means for locking the pin in the hole. In one embodiment of the invention, the means for locking the pin comprises a strip having tabs on each of its ends that are disposed adjacent opposite faces of the rotor.

The current invention also encompasses a method of installing a blade in a turbo-machine rotor, comprising the steps of (i) sliding a root portion of the blade into a groove formed in the rotor, (ii) inserting a pin having a first slot formed therein into a hole formed by mating notches, the mating notches formed in opposing faces of the rotor groove and the blade root, (iii) rotating the pin so as to align the first slot with a second slot formed in the rotor, (iv) sliding a retaining strip through the first and second slots, and (v) bending a first end of the tab against a first face of the rotor.

DESCRIPTION OF THE PREFERRED EMBODIMENT

Figure 1:
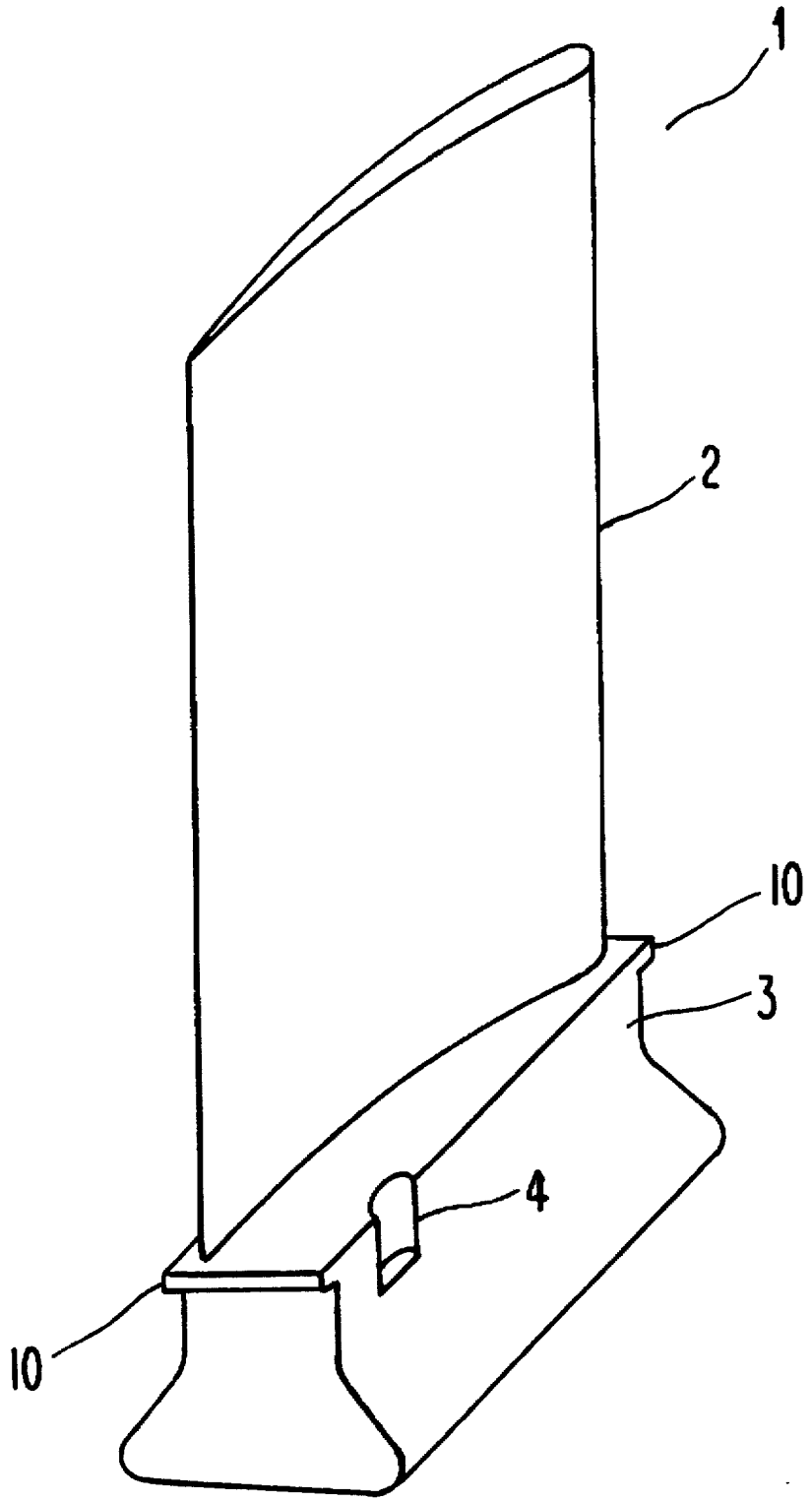
FIG. 1 is an isometric view of a gas turbine compressor blade according to the current invention.

Referring to the drawings, there is shown in FIG. 1 a gas turbine compressor blade 1 according to the current invention. As is conventional, the blade 1 is comprises of an airfoil portion 2 and a root portion 3. The blade root 3 preferably has a dove-tail shape, as shown. According to an important aspect of the invention, a notch 4 is formed in one side of the blade root 3. The notch 4 is radially oriented and, preferably, has a semi-circular cross-section.

Figure 2:
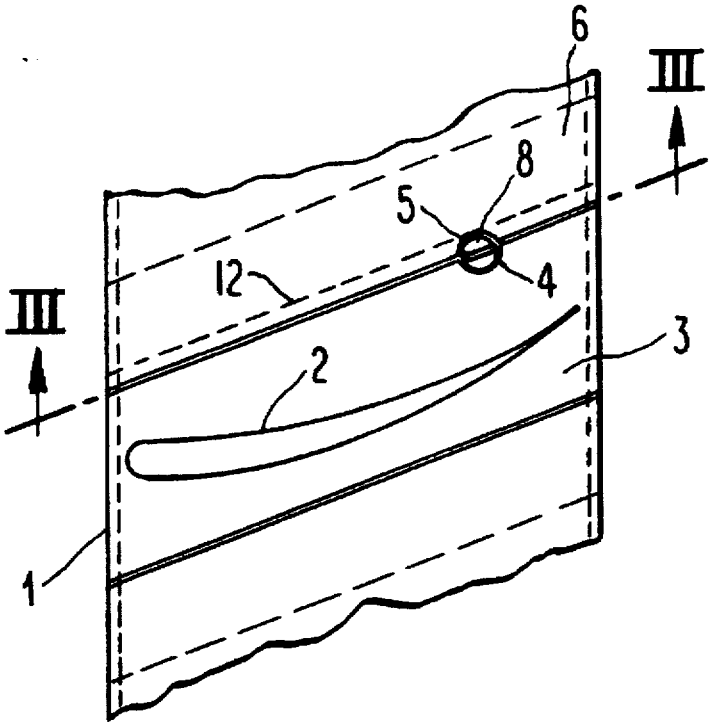
FIG. 2 is a plan view of the compressor blade shown in FIG. 1 as installed in a compressor rotor.
Figure 3:
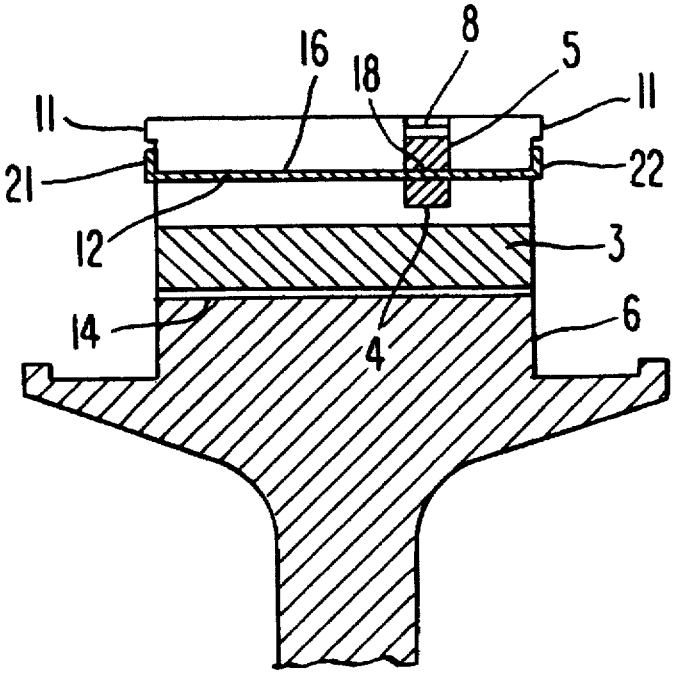
FIG. 3 is a cross-section taken along line III—III shown in FIG. 2.

FIGS. 2 and 3 show the blade 1 installed in the shaft of a compressor rotor 6. As is conventional, the blade 1 is secured to the rotor shaft 6 by means of a groove 14 formed in the periphery of the rotor. As is also conventional, the groove 14 has a shape that corresponds to that of the blade root 3 so that the walls of the groove restrain the blade root from motion in the circumferential and radial directions. According to an important aspect of the current invention, the rotor groove 14 has a notch 5 formed in the wall of the groove that faces the blade root wall in which the notch 4 is formed. The notch 5 is radially oriented and has a size and cross-sectional shape that matches that of the notch 4. Thus, the notch 5 preferably has a semi-circular cross-section.

According to a further aspect of the current invention, the groove 14 has a slot 16 that extends along the length of the groove and intersects the notch 5. As shown best in FIG. 4, the slot 16 preferably has a rectangular cross-section.

As shown in FIG. 2, the notches 4 and 5 are located along the blade root 3 and rotor groove 14 so that they are aligned, with notch 4 facing in opposition to notch 5. Thus, when the blade root 3 is installed in the groove 14, the notches 4 and 5 form a blind hole, with the notch 4 forming half of the periphery of the hole and the notch 5 forming the other half of the periphery.

A pin 8, which is preferably cylindrical, is also provided. The pin 8 has a first slot 18 formed in its cylindrical body portion and a second slot 20 in one of its end faces. The diameter of the pin 8 is preferably slightly smaller than the diameter of the blind hole formed by the mating notches 4 and 5.

A retaining strip 12 is also provided. The retaining strip preferably has a pre-bent tab 22 on one of its ends. The tab 22 is preferably oriented at an angle of 90° to the body of the strip 12. The opposite end of the retaining strip 12, which is initially unbent, forms a second tab 21. The retaining strip is formed from a material and is of such thickness to permit the bending of the tab 21 during assembly, as discussed below. In one embodiment of the invention, the retaining strip is formed from 403 stainless steel and is 0.89 cm(0.35 inch) long and 0.19 cm (0.075 inch) wide. The length of the retaining strip 12 should be slightly longer than the slot 16 in the rotor groove 14.

Figure 4:
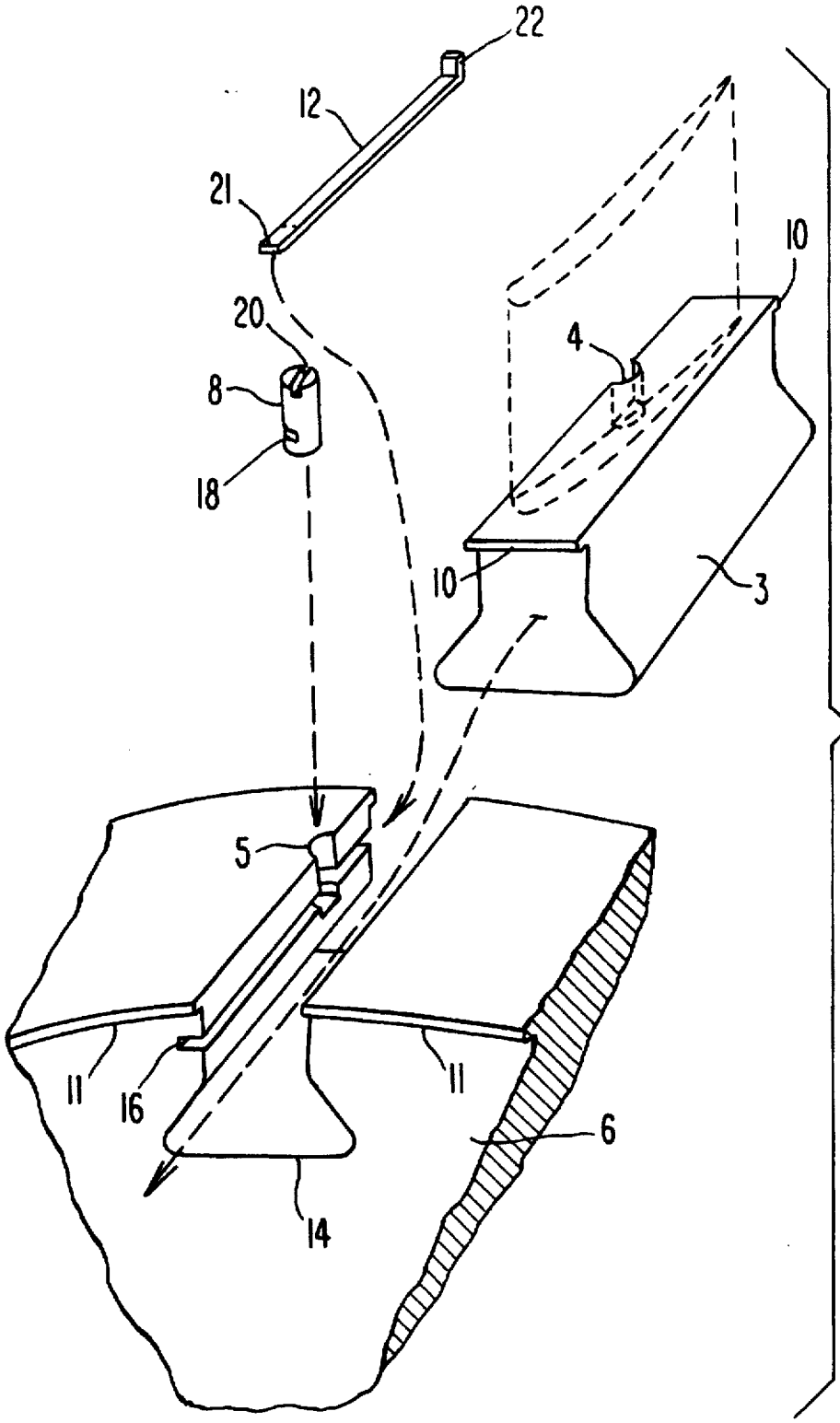
FIG. 4 is an exploded view of the blade locking apparatus according to the current invention.

FIG. 4 is an exploded view showing the installation of the various components of the apparatus for locking the compressor blade 1 into the rotor 6 so as to prevent motion in the axial direction—that is, in a direction parallel to the axis of the groove 14.

At assembly, the blade root 3 is slid into the rotor groove 14 so that the notches 4 and 5 mate, forming the blind hole. The radial pin 8 is then inserted into the blind hole, thereby preventing the blade root 3 from further motion in the axial direction. The pin 8 is then rotated so that the slot 18 in the body of the pin is aligned with the slot 16 in the groove. To facilitate this rotation, a flat head screw driver can be inserted into the slot 20 in the end of the pin 8.

The retaining strip 12 is then slid into the slot 16 in the rotor groove so that it extends through the slot 18 in the body of the pin 8, thereby restraining the pin from motion in the radial direction. Insertion of the retaining strip 12 continues until the pre-bent tab 22 rests against the rear face of the rotor 6, as shown best in FIG. 3. The tab 21 at the opposite end of the retaining strip 12 is then bent upward against the front face of the rotor 6, thereby locking the retaining strip in the groove 14.

Alternatively, the groove slot 16 could be moved radially outward so that the retaining strip 12 was installed above the pin 8. In this embodiment, the pin slot 18 would be eliminated because the head of the pin 8 would engage the retaining strip 12. Moreover, in this embodiment, half of the slotted head of the pin 8 could be removed so that the remaining half of the pin head projected above the retaining strip, thereby making for ready visual determination that the pin had been installed.

As also shown best in FIG. 3, projections 10 and 11 extend from the faces of the blade root 3 and rotor 6, respectively. The projections 10 and 11 overhang the tabs 21 and 22 and protect them from damage.

As can be seen, the apparatus allows the blade 1 to be securely locked in the rotor groove 14 while permitting ready visual inspection to ensure that the pins 8 are installed and locked in place by the retaining strips 12.

At disassembly, the tab 21 is unbent so that the retaining strip 12 can be withdrawn and discarded. The pin 8 is then extracted from the hole formed by the mating notches 4 and 5 so that the blade 1 can be slid out of the rotor groove 14. Thus, removal of individual blades 1 is readily accomplished.

Although the invention has been described with reference to locking a compressor blade in the rotor of a gas turbine, the invention is also applicable to other types of blades in other types of turbo-machines. Accordingly, the present invention may be embodied in other specific forms without departing from the spirit or essential attributes thereof and, accordingly, reference should be made to the appended claims, rather than to the foregoing specification, as indicating the scope of the invention.

I claim:

1. A turbo-machine rotor assembly, comprising:

a) a blade having a root portion, a first notch formed in said root, said notch forming a portion of the periphery of a hole;

b) a shaft having a groove for retaining said blade root, said groove forming a wall, a second notch formed in said groove wall, said second notch disposed opposite said first notch and forming the remaining portion of said periphery of said hole;

c) a locking pin disposed in said hole formed by said first and second notches;

d) means for restraining motion of said pin in the radial direction so as to retain said pin in said first and second notches, said restraining means comprising (i) a strip having first and second ends and a body portion therebetween, and (ii) a slot formed in said groove wall and intersecting said second notch in said groove wall, said body portion of said strip being disposed in said slot and engaging said pin; and e) means for restraining motion of said strip in the axial direction so as to retain said strip within said slot, said strip restraining means comprising (i) said strip first end forming a first tab oriented at an angle to said strip body portion, and (ii) said strip second end forming a second tab bent at an angle to said body portion.

2. The turbo-machine rotor according to claim 1, wherein said first tab engages a first face of said shaft.

3. The turbo-machine rotor according to claim 2, wherein a portion of said shaft extends over said first tab.

4. The turbo-machine rotor according to claim 1, wherein said slot extends along the length of said shaft groove.

5. The turbo-machine rotor according to claim 1, wherein said pin has a first slot formed therein, said retaining strip extending through said first pin slot.

6. The turbo-machine rotor according to claim 5, wherein said pin has first and second ends and a body portion extending therebetween, said first pin slot being formed in said pin body portion, a second slot formed in said first end of said pin.

7. The turbo-machine rotor according to claim 1, wherein said pin has a shape, and wherein said first and second notches have shapes that correspond to portions of said pin shape.

8. The turbo-machine rotor according to claim 7, wherein said pin has a circular cross-section, and wherein said first and second notches each have a semi-circular cross-section.

9. The turbo-machine rotor according to claim 1, wherein said pin is radially oriented.

10. The turbo-machine rotor according to claim 1, wherein said second notch extends radially and said slot extends axially.

11. The turbo-machine rotor according to claim 1, wherein said pin restraining means further comprises said hole formed by said first and second notches being a blind hole.

12. The turbo-machine rotor according to claim 1, wherein said groove wall is a side wall, and wherein said blade root also forms a side wall, said first notch formed in said blade root side wall, and wherein said retaining strip is disposed laterally between said groove side wall and said notch side wall.

13. The turbo-machine rotor according to claim 1, wherein said second notch has first and second ends, said slot intersecting said second notch at a point intermediate said first and second notch ends.

14. A method of installing a blade in a turbo-machine rotor shaft, comprising the steps of:

a) sliding a root portion of said blade into a groove formed in said shaft;

b) inserting a pin having a first slot formed therein into a hole formed by mating first and second notches, said first and second notches formed in first and second opposing faces of said groove and said blade root, respectively;

c) rotating said pin so as to align said first slot with a second slot formed in said first face of said groove and intersecting said first notch;

d) restraining said pin from motion in the radial direction within said hole by sliding a retaining strip through said first and second slots; and e) restraining said retaining strip from motion in the axial direction within said second slot by bending a first end of said retaining strip.

15. The method according to claim 14, wherein said strip has a second end, a tab oriented at an angle to said stip formed on said second end, and wherein the step of sliding said retaining strip through said first and second slots comprises sliding said retaining strip until said tab is disposed adjacent a face of said rotor.

* * * * *